US006280232B1

(12) United States Patent
Beecher et al.

(10) Patent No.: US 6,280,232 B1
(45) **Date of Patent: *Aug. 28, 2001**

(54) COMMUNICATION CABLE TERMINATION

(75) Inventors: Robert L. Beecher, Fishers, IN (US); Bryan S. Moffitt, Red Bank, NJ (US); Louis D. Vining, Indianapolis, IN (US)

(73) Assignee: Avaya Technology Corp., Basking Ridge, NJ (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/052,528

(22) Filed: Mar. 31, 1998

(51) Int. Cl.[7] ..... H01R 4/24

(52) U.S. Cl. ..... 439/418; 439/460; 439/610; 439/676

(58) Field of Search ..... 439/418, 676, 439/460, 610

(56) References Cited

U.S. PATENT DOCUMENTS

| | | | | |
|---|---|---|---|---|
| 4,607,905 | * | 8/1986 | Vaden | 439/676 |
| 5,186,649 | | 2/1993 | Fortner et al. | 439/460 |
| 5,194,014 | * | 3/1993 | McClune et al. | 439/404 |
| 5,249,987 | * | 10/1993 | Kristiansen | 439/676 |
| 5,505,638 | | 4/1996 | Su et al. | 439/676 |
| 5,571,035 | * | 11/1996 | Ferrill | 439/894 |
| 5,772,465 | | 6/1998 | Hwang et al. | 439/418 |
| 5,888,100 | * | 3/1999 | Bofill et al. | 439/676 |
| 5,899,770 | * | 5/1999 | Ezawa | 439/418 |

FOREIGN PATENT DOCUMENTS

| | | | |
|---|---|---|---|
| 0716477 A2 | 6/1996 | (EP) | H01R/23/00 |
| 0793305 A2 | 9/1997 | (EP) | H01R/13/65 |
| 0840406 A2 | 5/1998 | (EP) | H01R/23/02 |

OTHER PUBLICATIONS

U.S. Patent application Ser. No. 08/922,920; filed Sep. 3, 1997, entitled "*Communication Plug*", Inventors: Enzs: Lin; and Reichard.

U.S. Patent application Ser. No. 08/922,621; filed Mar. 3, 1997, entitled "*Strain Relief Apparatus For Use In A Communication Plug*", Invenntors: Chapman; Chavez; Ensz; Garibay; and Reichard.

U.S. Patent application Ser. No. 08/922,580; filed Sep. 3, 1997, entitled "*Low Crosstalk Assembly Structure For Use In A Communication Plug*"; Inventors: Larsen; Lin; Pharney; and Reichard.

U.S. Patent application Ser. No. 08/923,382; filed Sep. 3, 1997, entitled "*Blade Carrier For Use In A Communication Plug*"; Inventors: Lin; Reichard; and Steele.

(List continued on next page.)

*Primary Examiner*—Hien Vu
*Assistant Examiner*—Truc Nguyen

(57) ABSTRACT

A modular communication plug for terminating a cable having a plurality of conductors disposed therein. The communication plug comprises a substantially hollow housing forming a chamber and having a conductor alignment region disposed at one end and an opening to the chamber at the other end. A carrier for orienting the conductors for reception in the alignment region is carried in the chamber. The carrier is inserted under the cable jacket and receives and organizes the conductors in channels formed therein to maintain a consistent routing of the conductors as they exit the end of the cable jacket. Furthermore, the carrier maintains this organization while an anchor bar or similar strain relief mechanism is tightened over the jacket. For adjusting the crosstalk generated in the plug, a crosstalk fixing member is interposed between the orienting member and the alignment region. A plurality of conductive terminals are disposed proximal to the alignment region for establishing electrical contact with the conductors.

22 Claims, 9 Drawing Sheets

OTHER PUBLICATIONS

U.S. Patent application Ser. No. 08/922,623; filed Sep. 3, 1997, entitled "*Alignment Apparatus For Use In The Jack Interface Housing Of A Communication Plug*"; Inventors: Reichard; and Steele.

U.S. patent application Ser. No. 09/047,870; filed Mar. 25, 1998, entitled "*Crosstalk Compensation for Connector Jack*"; Inventors: Pharney; Reed; and Spitz.

* cited by examiner

COMMUNICATION CABLE TERMINATION

FIELD OF THE INVENTION

The present invention relates generally to the field of cable connectors and more specifically to a modular plug for terminating round cables or cordage carrying conductor pairs.

BACKGROUND OF THE INVENTION

In the telecommunications industry, modular plug type connectors are commonly used to connect customer premise equipment (CPE), such as telephones or computers, to a jack in another piece of CPE, such as a modem, or in a wall terminal block. These modular plugs terminate essentially two types of cable or cordage: ribbon type cables and round cables.

In ribbon type cables, the conductors running therethrough are arranged substantially in a plane and run, substantially parallel, alongside each other throughout the length of the cable. The individual conductors may have their own insulation or may be isolated from one another by channels defined in the jacket of the ribbon cable itself, with the ribbon jacket providing the necessary insulation. Conversely, the conductors packaged in a standard round cable may take on a random or intended arrangement with conductors being twisted or wrapped around one another and changing relative positions throughout the cable length.

Traditional modular plugs are well suited for terminating ribbon type cables. Typically, these plugs are of a dielectric, such as plastic, structure in which a set of terminals are mounted side by side in a set of troughs or channels in the plug body such that the terminals match the configuration of the conductors in the cable connected thereto. When the plug is inserted into a jack, the terminals will electrically engage jack springs inside the jack to complete the connection.

On the other hand, termination of standard round cables or cords poses unique assembly problems for the skilled technician. For example, termination of a round cable carrying, for example, four conductor pairs by means of an existing modular plug requires the following steps: First, the cable or cord jacket must be stripped to access the enclosed conductors. Next, because the conductors in a conductor pair are generally twisted around one another, the twist must be removed and the conductors oriented to align with the required interface. For some standardized plugs, aligning the conductors also involves splitting the conductors in at least one of the pairs and routing these over or under conductors from other pairs while orienting all the conductors in a side-by-side plane. Once the conductors are aligned in a plane, they may be joined to the terminals in the plug. However, the orientation process can result in various conductors of different pairs crossing over each other, thereby inducing crosstalk among the several conductor pairs.

Crosstalk is defined as the cross coupling of electromagnetic energy between adjacent conductor pairs in the same cable bundle or binder. Crosstalk can be categorized in one of two forms: Near End Crosstalk, commonly referred to as NEXT, is the most significant because the high energy signal from an adjacent conductor can induce relatively significant crosstalk into an attenuated receiver signal. The other form is Far End Crosstalk or FEXT. FEXT is typically less of an issue because the far end interfering signal is attenuated as it traverses the loop. Because the jack springs, conductors and the plug terminals or contacts near the jack springs are generally quite close to, and exposed to, one another in a communication plug, control of crosstalk is a paramount consideration in any plug design. Unfortunately, crosstalk in a communication plug cannot be merely eliminated. Jacks are engineered to generate a certain amount of compensating crosstalk to counter the crosstalk produced in the plug. Accordingly, a communication plug should be designed to optimize rather than just minimize crosstalk.

In addition, the technician time involved in the prior art practice of separating out the twisted pairs of conductors and routing them to their proper terminals in the plug is considerable. Even if the technician, splicer, or other assembly person is accurate in the disposition of the conductors, the time consumed by him or her in achieving such accuracy is considerable. Thus, the time spent in properly routing the conductors can add considerable cost. Where it is appreciated that thousands of such connections are made daily, involving at least hundreds of technicians, it can also be appreciated that any reduction in time spent in assembling the plug can be of considerable economic importance.

Accordingly, there exists a need for a modular plug that can terminate a standard round cable and that provides a straightforward interface between the conductors in the cable and the plug terminals, involving less assembly time than heretofore. In addition, it is desirable that such a plug be capable of optimizing crosstalk through fixing the crosstalk level during manufacture or assembly. In this context, optimization means reducing crosstalk in the plug or providing a predetermined level of crosstalk to match the requirements of a jack designed to eliminate an expected crosstalk level.

SUMMARY OF THE INVENTION

Certain objects, advantages and novel features of the invention will be set forth in the description that follows and will become apparent to those skilled in the art upon examination of the following or may be learned with the practice of the invention.

The present invention is generally directed to a modular communication plug or connector for terminating a cable having a plurality of conductors disposed therein. The communication plug comprises a substantially hollow housing forming a chamber and having a conductor alignment region disposed at one end and an opening to the chamber at the other end. A member for orienting the conductors for reception in the alignment region is carried in the chamber. For setting the amount of crosstalk generated in the plug, a crosstalk fixing member is interposed between the orienting member and the alignment region. A plurality of conductive terminals are disposed proximal to the alignment region for establishing electrical contact with the conductors.

According to an aspect of the invention, the member for orienting the conductors comprises a carrier or mandrel having a substantially planar body that segregates the conductors, typically pairwise, and terminates in a distribution end that arranges the individual conductors according to the pattern defined by the alignment region. Inasmuch as the conductors are generally configured as twisted pairs, the mandrel maintains the pair orientation along the length of the mandrel body until the conductors are routed into individual slots at the mandrel distribution end. Furthermore, such a carrier or mandrel can be applied as a cable termination for any jacketed cable. The mandrel is inserted under the cable jacket and it receives and organizes the conductors in channels formed therein to maintain a consistent routing of the conductors as they exit the end of the cable jacket. Advantageously, the mandrel maintains this organization while an anchor bar or similar strain relief mechanism is tightened over the jacket. In addition, the mandrel can extend beyond the end of the jacket to align the conductors according to the requirements of another termination device such as a plug carrying terminal contacts.

According to another aspect of the invention, the crosstalk fixing means comprises a sled component that is used to define the length of the region in which the conductors are untwisted and arranged parallel to one another. Accordingly, the skilled artisan can fix the amount of crosstalk developed in the plug by altering the length of the sled without altering the overall dimensions of the communication plug, which would require additional tooling costs. This allows the communication plug according to the present invention to work with legacy jacks that require a certain amount of complementary crosstalk to be generated in the plug for optimum performance.

In an alternative embodiment, the alignment region in the communication plug housing is removed and the distribution end of the mandrel is adapted to fill the space vacated by the alignment region. In this embodiment, the twist in the conductor pairs is moved as near as possible to the conductive terminals thereby minimizing the crosstalk developed in the plug. It is envisioned that this plug design will be desirable for use with future jacks that require less complementary crosstalk from the plug. Moreover, another advantage of this embodiment is that the detailed assembly steps can be done outside of the plug housing, which allows for greater precision and reduced assembly time over prior art plug designs.

Additional advantages will become apparent from a consideration of the following description and drawings:

BRIEF DESCRIPTION OF THE DRAWINGS

Other features of the present invention will be more readily understood from the following detailed description of specific embodiments thereof when read in conjunction with the accompanying drawings, in which.

DETAILED DESCRIPTION

Figure 1:
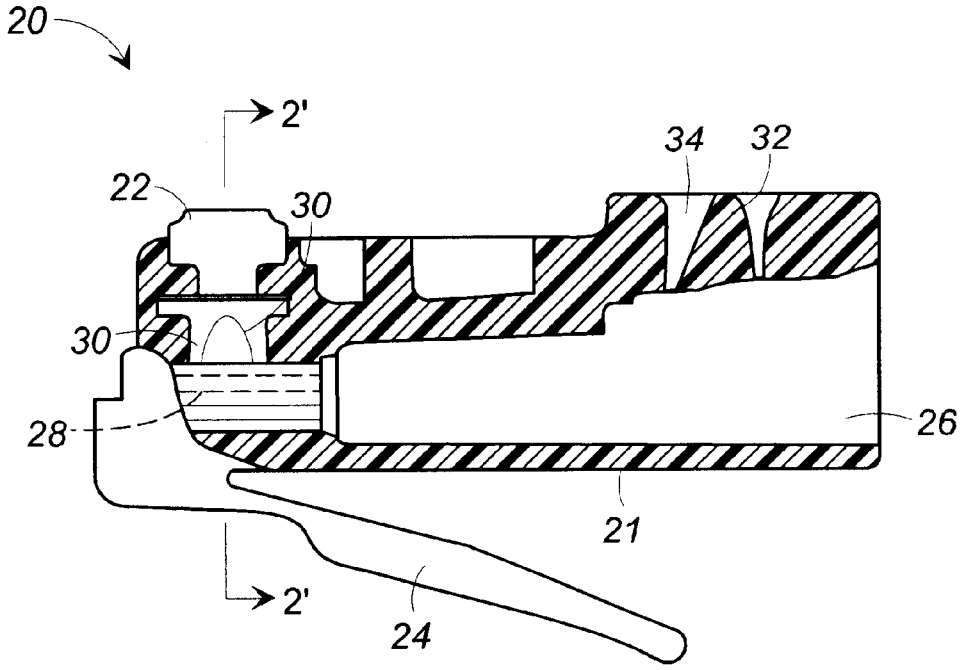
FIG. 1 is a cross sectional view of the communication plug according to the present invention.

A communication plug or connector 20 according to the present invention is shown in FIG. 1. Communication plug 20 is preferably made from a suitable dielectric (e.g., plastic) material and comprises a substantially hollow shell or housing 21 having side walls, upper and lower walls and a plurality of slots formed in one end thereof for holding a plurality of electrical terminals or contacts 22. Electrical terminals 22 are used to electrically communicate with jack springs contained in a wall terminal block or other device containing a jack interface. The number of terminals 22 and the dimensions of communication plug 20 are dependent on the number of conductors or wires to be terminated and/or connected and the shape of the jack in which communication plug 20 is received. For most applications, the general shape of communication plug 20 remains consistent with the number of terminals 22 varying in relation to the number of conductors. To secure communication plug 20 in a jack, communication plug 20 includes a resilient latch 24 extending from its lower surface. Latch 24 comprises an elongated arm having locking edges (not shown) formed transversely to the arm length. Because latch 24 is secured to communication plug 20 at only one end, leverage may be applied to latch 24 to raise or lower the locking edges. When communication plug 20 is inserted into a jack, pressure can be applied to latch 24 for easy entry, which, when released, allows the locking edges of latch 24 to return to the locking position. Once communication plug 20 is seated within the jack, latch 24 can be released causing the locking edges to be held behind a plate forming the front of the jack thereby securing the connection. Similarly, communication plug 20 can be released via leverage on latch 24 to free the locking edges from behind the jack plate so that communication plug 20 can be removed. Such a latching arrangement is well known in the art.

Figure 2:
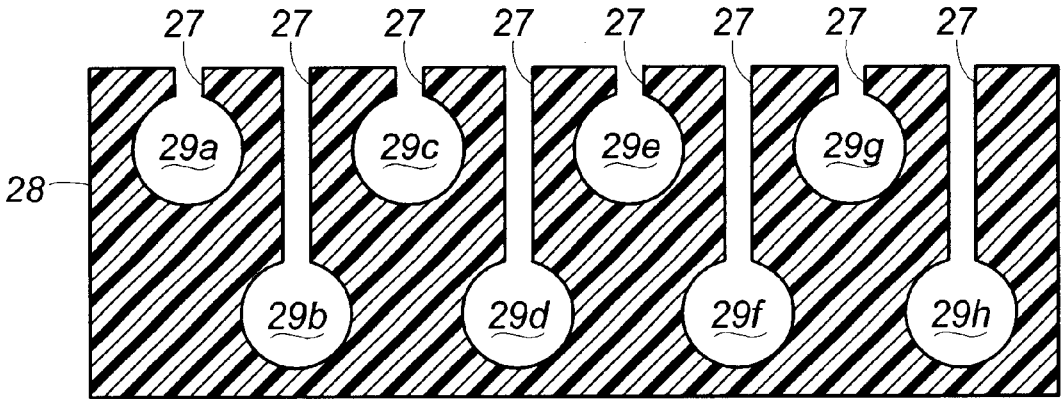
FIG. 2 is a cross sectional view of the alignment region of the communication plug taken along line 2'—2' of FIG. 1.
Figure 3:
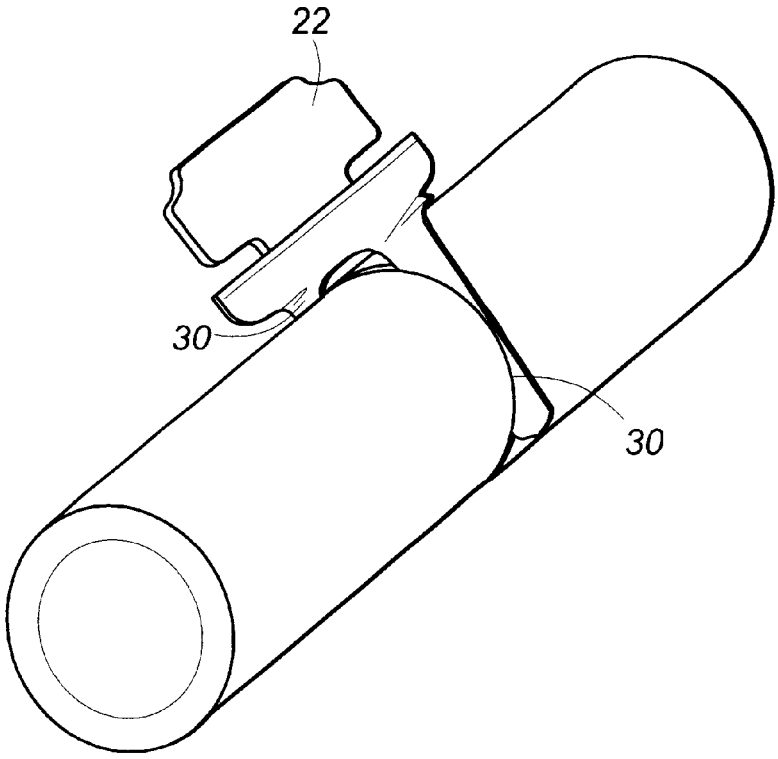
FIG. 3 is a perspective view of a terminal from FIG. 1 in engagement with an insulated conductor.

Communication plug 20 further includes a rectangular opening in one end leading to passage or chamber 26 for receiving conductors or wires from a cable or cord. At the other end of chamber 26, communication plug 20 contains an integrated alignment region 28 in which the conductors are positioned for connection to terminals 22. FIG. 2 provides a cross sectional view of alignment region 28 illustrating the plurality of channels 29*a,b,c,d,e,f,g,h* formed therein. Channels 29 further include slots 27 that provide terminals 22 access to the conductors. Terminals 22 are designed with a bifurcated end comprising dual, elongated prongs 30 forming a gap therebetween. Dual prongs 30 extend down into the individual channels 29 through slots 27 to straddle an insulated conductor held therein as illustrated in greater detail in FIG. 3. Through sharp inner edges, dual prongs 30 penetrate the outer insulation to establish electrical contact with the enclosed conductor.

Figure 4:
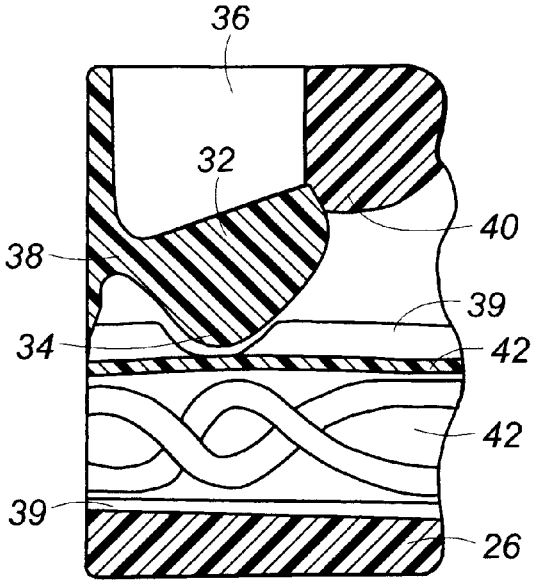
FIG. 4 is a detailed cross sectional view of the anchor bar used in the communication plug in engagement with a cable.

Strain relief for a terminated cable is provided by anchor bar 32, which is illustrated in its engaged position in FIG. 4. Anchor bar 32, which includes a surface 34 for engaging the cable, is initially disposed in opening 36 in the top of communication plug 20. When anchor bar 32 is in this inoperative position, it is supported in opening 34 via flexible hinge 38 and temporary side tabs (not shown) extending from the walls forming opening 36. When the cable is in place in chamber 26 and is ready to be secured, downward force is applied by the installer or operator to anchor bar 32 such that anchor bar 32 is compressed and pivots about hinge 38 until it enters chamber 26 so that surface 34 is substantially aligned with the entry direction defined by chamber 26. In this position, surface 34 enters into engagement with the cable jacket or sheath 39 and presses downward upon carrier or mandrel 42, which will be described in detail hereafter, so that the cable is firmly held within chamber 26, but the structural integrity of the cable and the underlying conductors are not unduly distressed. Once inside chamber 26, anchor bar 32 tends to return its original position and a portion thereof engages surface 40 of the upper wall forming communication plug 20. In this operative position, anchor bar 32 is effective in preventing relative movement between communication plug 20 and the cable external to the plug from affecting the cable position internal to the plug. The anchor bar as just described is the subject of U. S. Pat. No. 5,186,649 to Fortner et al., which is incorporated herein by reference.

Figure 5:
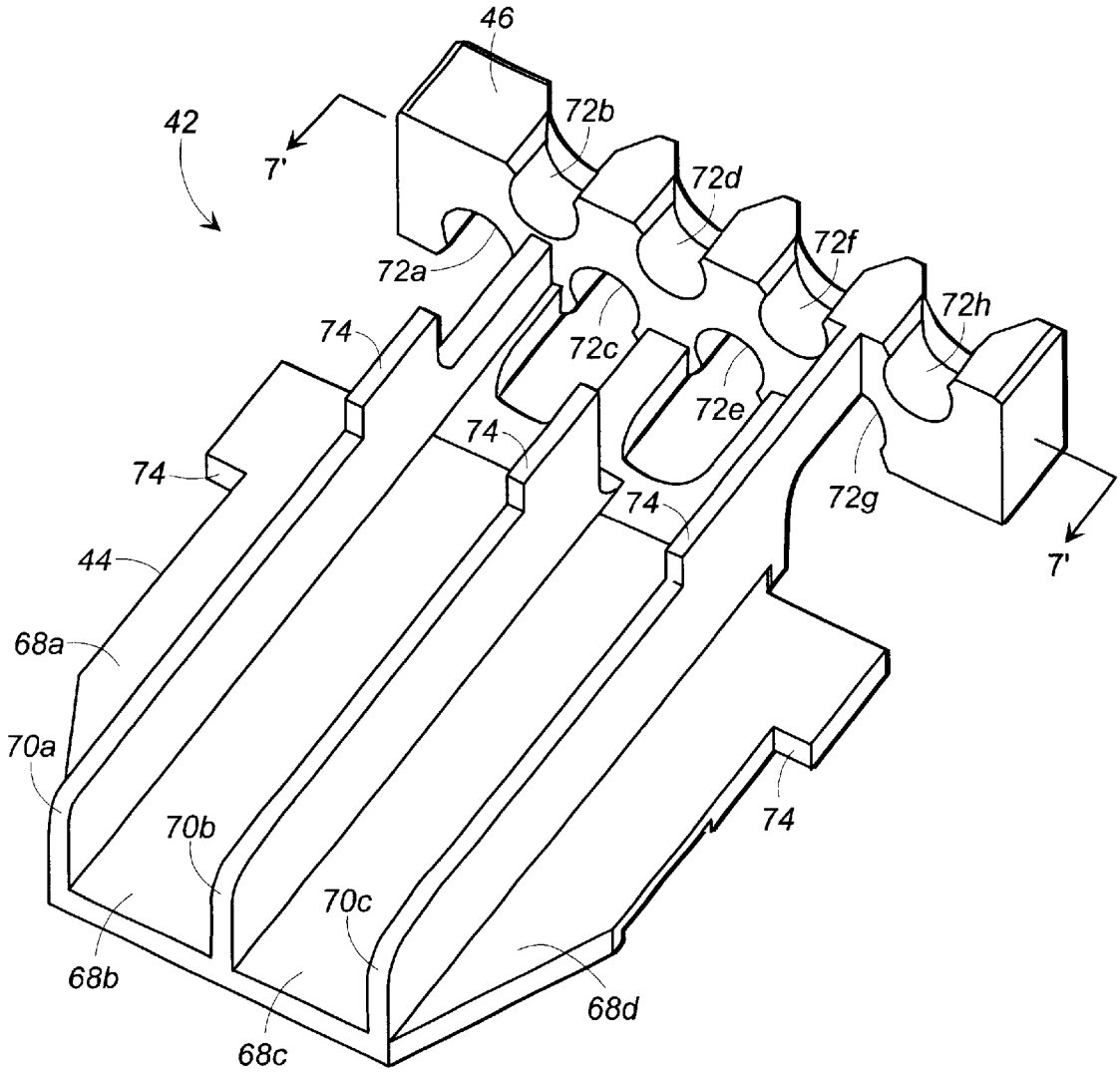
FIG. 5 is a perspective view of a mandrel according to the present invention that is used to interface the conductors or wires held in a cable to the communication plug.

Turning now to FIG. 5, the internal components of communication plug 20 will be described hereafter. FIG. 5 depicts a wire/conductor carrier or mandrel 42 having a substantially planar body 44 terminated by a conductor distribution end 46. Mandrel 42, as illustrated in FIG. 5, is designed to terminate an eight-wire (i.e., four-pair) cable such as exemplary cable 48 shown in FIG. 6 and is typically constructed from a non-conducting, low dielectric material such as plastic. Nevertheless, the skilled practitioner will appreciate that the principles of the present invention discussed herein can be applied to cables carrying fewer or more conductors or wire pairs.

Figure 6:
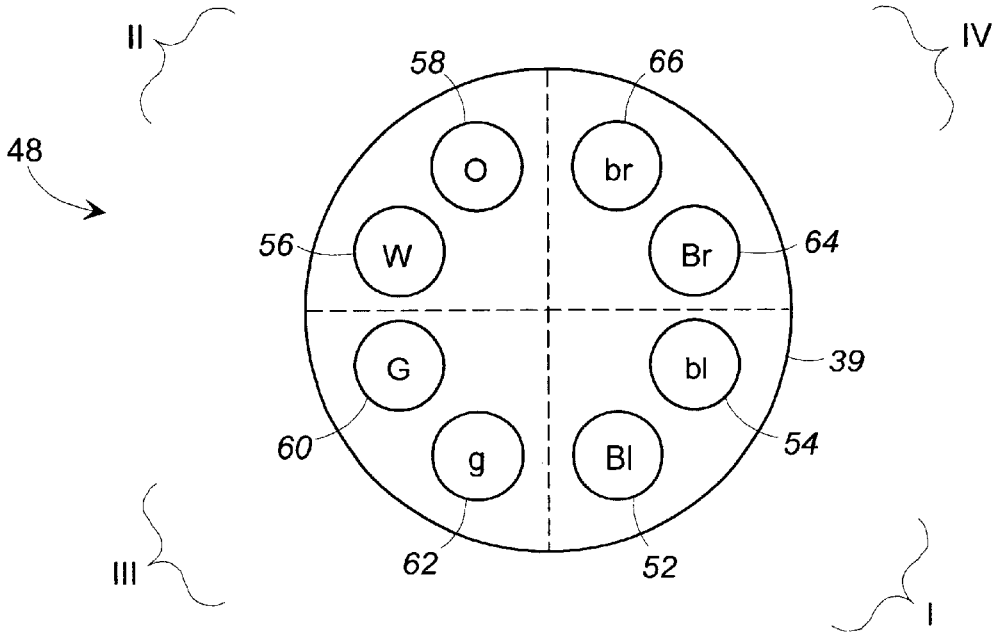
FIG. 6 is an idealized cross sectional view of a standard eight-wire communication cable to be terminated by the communication plug.

It is helpful at this point to review the design of cable 48, which is representative of communication cables commonly used in the art and illustrated in FIG. 6. Cable 48 comprises eight, insulated conductors or wires held in a protective sheath 39 typically made from poly-vinyl chloride (PVC) or other suitable material. The eight conductors are generally arranged in four, two-wire pairs in which the wires comprising each pair twist around one another throughout the length of cable 48. Moreover, the wire pairs themselves generally twine or twist around one another as well. In the example shown in FIG. 6, the first wire pair comprises dark blue wire 52 and light blue wire 54; the second wire pair comprises white wire 56 and orange wire 58; the third wire pair comprises dark green wire 60 and light green wire 62; and the fourth wire pair comprises dark brown wire 64 and light brown wire 66. The colors assigned to the wire insulation are exemplary of a common identification method used in eight-wire communication cables. It is well known in the art that twisting the individual wires comprising the wire pairs and twining the wire pairs around each other serves to substantially reduce crosstalk between the wires in the cable.

Returning now to FIG. 5, mandrel body 44 is shown to be subdivided into four channels 68*a,b,c,d* via dividing walls 70*a,b,c*. Channels 68*a,b,c,d* each receive one of the wire pairs from cable 48. For the eight-wire, four-pair cable 48, the plug assembly person will strip away a portion of sheath 39 to expose the wire pairs contained inside. The wire pairs in cable 48 are positioned in a generally circular arrangement. Therefore, the assembly person must reconfigure not only the wire pairs themselves, but the individual wires into a substantially planar arrangement having a predetermined ordering according to the signal or electrical assignments given to terminals 22. The unique design of mandrel 42 facilitates this orientation process via the combination of channels 68 and positioning slots 72. Once the wire pairs are unjacketed by the assembly person, they are each assigned a channel 68 according to the required mapping of the wires to terminals 22. In a standard eight-wire communication plug, pair IV (wires 64 and 66) is assigned to channel 68*a*; pair I (wires 52 and 54) is assigned to channel 68*b*; pair III (wires 60 and 62) is assigned to channel 68*c*; and pair II (wires 56 and 58) is assigned to channel 68*d*. To optimize the position, maximize the protection of the wires and to ensure a snug fit in communication plug 20 (i.e., provide a pliable interface amenable to minor deformation due to engagement with anchor bar 32), mandrel 42 is slid up into sheath 39 until the edge of sheath 39 abuts up against stops 74.

The skilled practitioner will appreciate that the present invention through mandrel 42 allows the pair orientation (i.e., twist) in the wire pairs to be maintained along the length of mandrel body 44 thus minimizing the onset of crosstalk. Dividing walls 70*a,b,c*, combat crosstalk that can develop between the wire pairs along with directing the wires towards their appropriate slots in conductor distribution end 46. It will be appreciated by those skilled in the art that other electrical parameters (balance, return loss, etc.) can also be optimized with a mandrel such as this. Equally important, however, is that these advantages are maintained within the engagement region of anchor bar 32 with sheath 39 (see FIG. 4) when mandrel 42 is inserted into plug 20 to complete the assembly. That is, mandrel 42 ensures that anchor bar 32 does not deform or distort the arrangement of the conductors while still cooperating with anchor bar 32 to provide the necessary strain relief.

Figure 7:
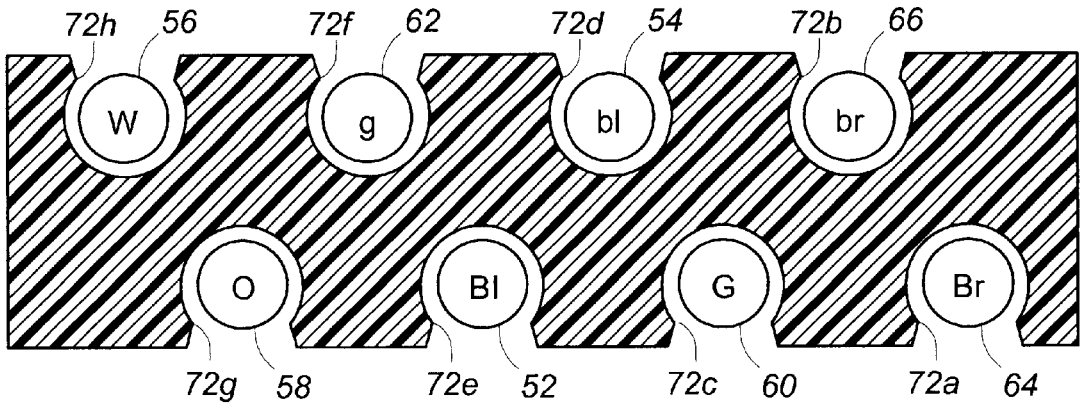
FIG. 7 is a cross sectional view of the conductor distribution end of the mandrel taken along line 7'—7' of FIG. 5 illustrating the routing assignments for the individual wires of the eight-wire cable.

At conductor distribution end 46, the assembly person removes the twist from each of the wire pairs and snaps each wire into its appropriate slot 72. FIG. 7 depicts a common mapping between the individual wires and slots 72*a,b,c,d, e,f,g,h*. Generally, the assigned slots 72 correspond with the assigned channels 68 for the wire pair; however, for pair III held in channel 68*c*, dark green wire 60 and light green wire 62 are split up to route to slots 72*c* and 72*f* respectively. This procedure typically involves running dark green wire 60 either over or under pair I comprising dark blue wire 52 and light blue wire 54.

With the individual wires in place in slots 72 and trimmed to a suitable length, mandrel 42 can be slid down into chamber 26 (see FIG. 1) until the wires meet alignment region 28. Alignment region 28 includes a set of passages or channels 29 having a compatible configuration to slots 72 for receiving the individual wires (i.e., channels 29 and slots 72 having the same letter designation are aligned with one another; see, e.g., FIGS. 2, 5 and 7). This allows the assembly person to insert the wires into channels 29 until the wire ends reach the terminals 22 located towards the nose end of communication plug 20. Using a crimping tool, terminals 22 are then pressed down into the wires thereby penetrating the outer insulation with their prongs 30 to form an electrical connection.

As discussed in the foregoing, one of the significant benefits of the present invention is the ability to maintain the pair orientation to prevent crosstalk even as the wires approach terminals 22 for connection. Nevertheless, while it may be desirable in future applications to eliminate virtually all crosstalk in the communication plug, legacy systems (i.e., current jacks) require a predetermined amount of crosstalk in the plug for optimum performance. Legacy jacks are engineered to compensate for crosstalk in the communication plug; thus, a well designed plug should generate crosstalk that is complementary to that used in the jack so the combination of the two crosstalk signals cancel each other out.

Figure 8:
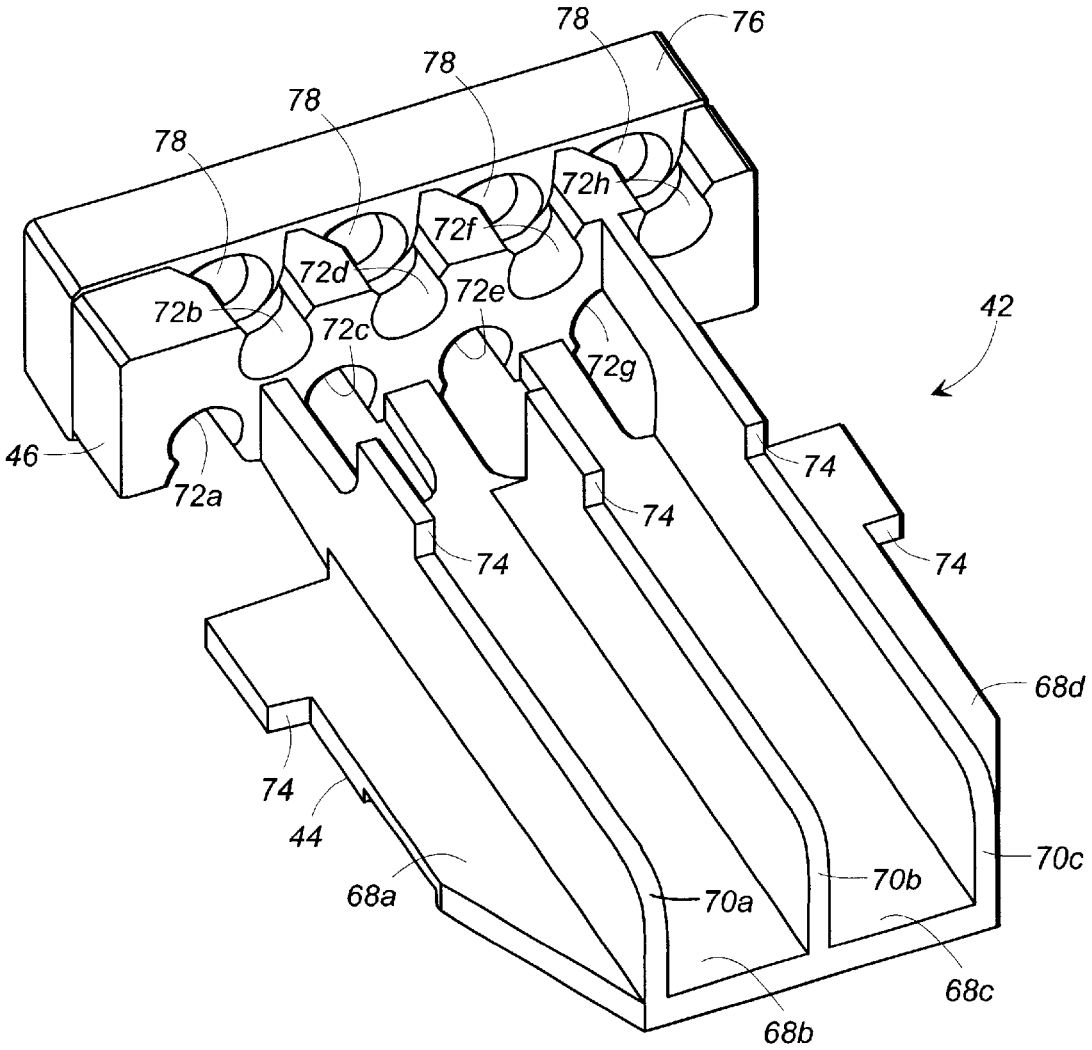
FIG. 8 is a perspective view of the mandrel in cooperation with a sled member for fixing the amount of crosstalk generated in the communication plug.
Figure 9:
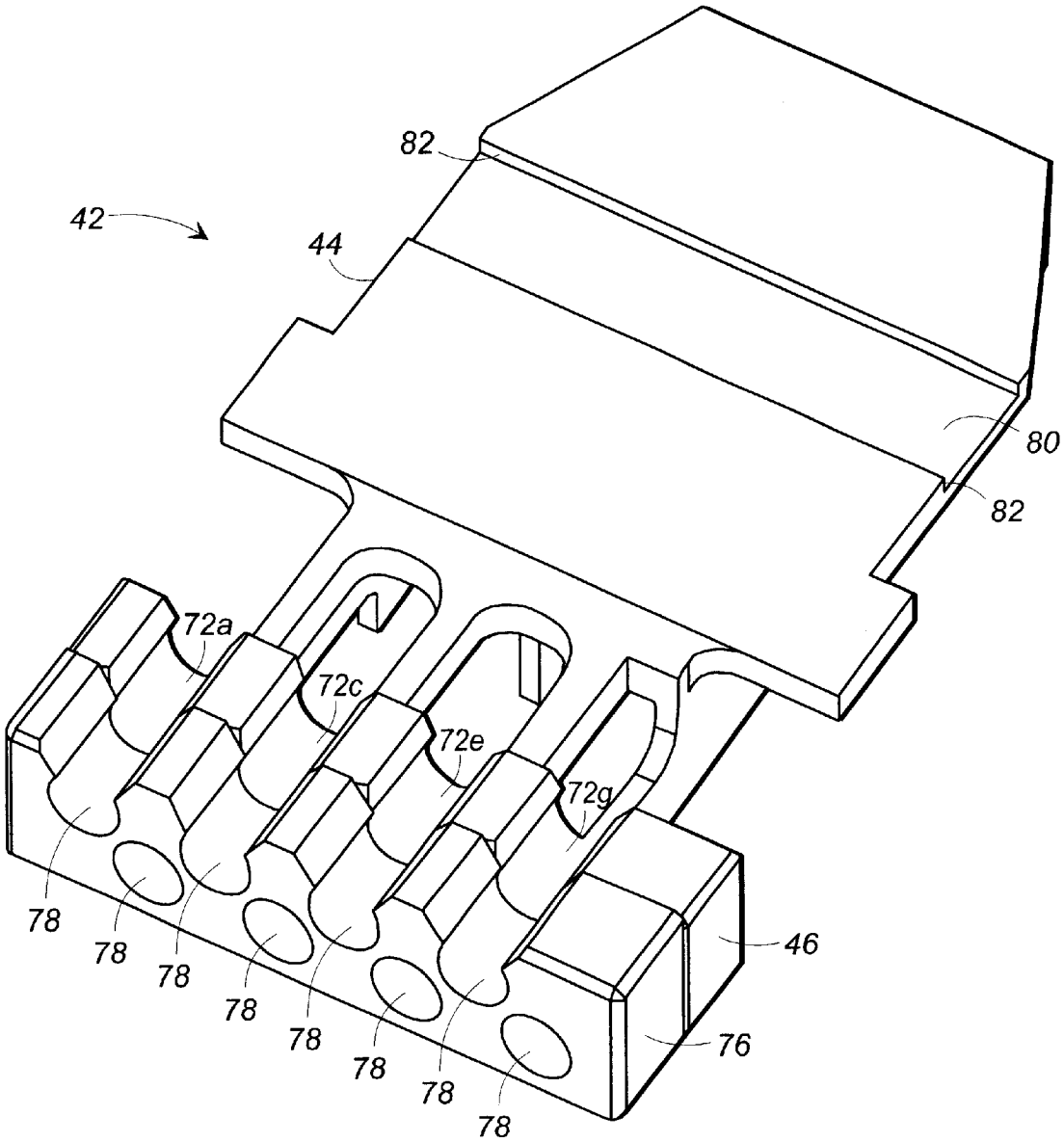
FIG. 9 is another perspective view of the mandrel and sled.

To fix the amount of crosstalk generated in communication plug 20, the present invention incorporates an additional component 76 known as a sled as illustrated in FIGS. 8 and 9. Sled 76 is designed with apertures and slots 78 (i.e., channels) that match slots 72 in conductor distribution end 46. Essentially, sled 76 acts as a spacer between conductor distribution end 46 of mandrel 42 and alignment region 28 of communication plug 20, Advantageously, sled 76 can be milled or molded to an appropriate length to generate the desired amount of crosstalk to adapt communication plug 20 to the crosstalk characteristics of a legacy jack. Sled 76 optimizes crosstalk between the wires by adjusting the length in which the wires are untwisted and run parallel to one another. It is envisioned that mandrel 42 and sled 76 can be modified or combined with other components to provide alternative crosstalk adaptation mechanisms such as changing the positioning of the conductors with respect to one another to alter their electrical characteristics. Furthermore, alternative design or manufacturing schemes may be employed such as combining mandrel 42 and sled 76 into a unitary component or integrating either or both mandrel 42 and sled 76 with plug 20.

Figure 12:
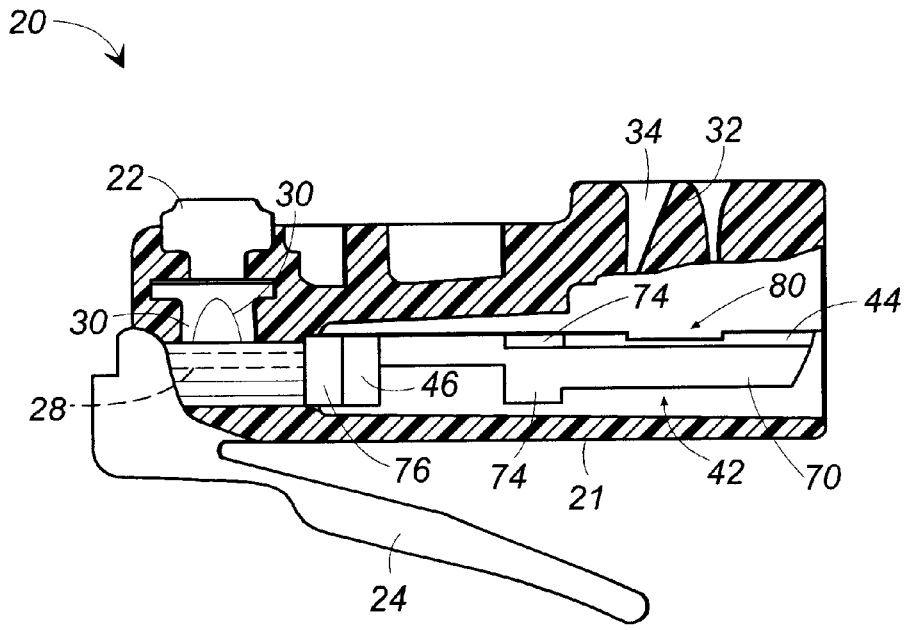
FIG. 12 is a cross sectional view of the communication plug of FIG. 1, shown with a sled and conductor carrier disposed therein.
Figure 14:
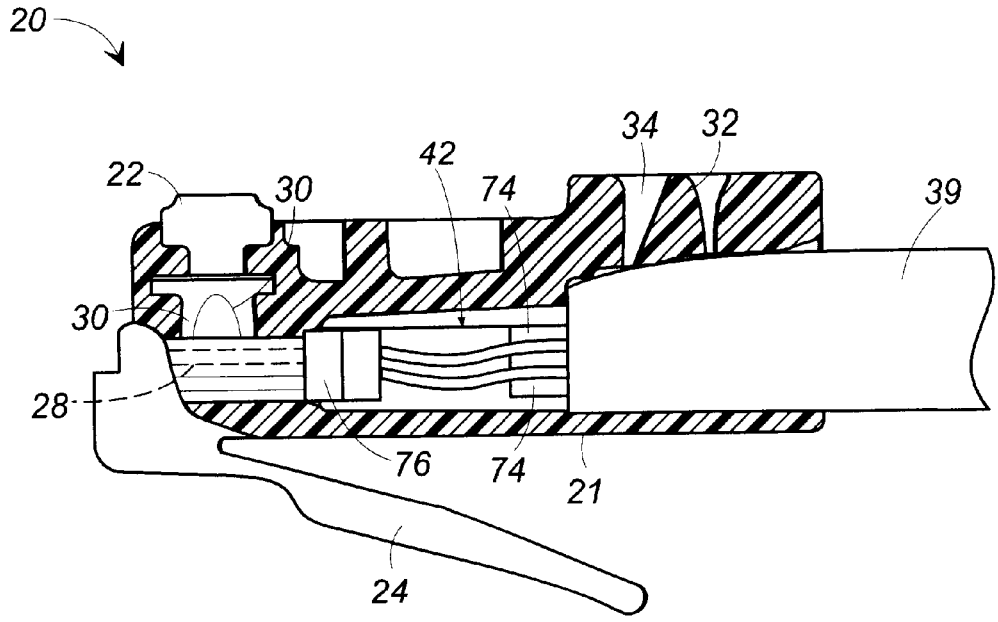
FIG. 14 is a cross-sectional view of the communication plug and conductor carrier of FIG. 12, shown with a cable inserted therein such that the conductor carrier is inserted between the cable sheath and twisted wire pairs.

An additional feature of mandrel 42 is depression region 80 as shown in FIG. 9. Recall from the discussion surrounding anchor bar 32, which was illustrated in FIG. 4, that anchor bar surface 34 engages cable is jacket or sheath 39 in chamber 26. Also recall from the foregoing discussion that mandrel 42 is slid underneath sheath 39 during the installation process. Thus, depression region 80 provides a means for receiving the portion of sheath 39 that is depressed by anchor bar surface 34. Flanges 82 defining the width of depression region provide an impediment to movement of mandrel 42 once secured by anchor bar 32. While mandrel 42 is oriented with depression region 80 positioned proximal to anchor bar 32 in the preferred embodiment, the invention may nevertheless still be practiced with mandrel 42 turned upside down from this configuration such that anchor bar 32 engages dividing walls 70*a,b,c* through sheath 39 to secure the cable and mandrel assembly. FIG. 12 shows the sled 76 and the conductor carrier or mandrel 42 disposed in the communication plug 20. FIG. 14 shows a communication cable inserted in the communication plug 20 such that the conductor carrier 42 disposed between the cable sheath 39 and the wire pairs.

As discussed earlier, new communication plugs must be capable of adapting to legacy wall jacks that require a certain amount of crosstalk to be generated in the plug if they are to be successful in today's marketplace. Nevertheless, it is envisioned that future applications may require communication plugs that minimize crosstalk to the greatest extent possible.

Figure 10:
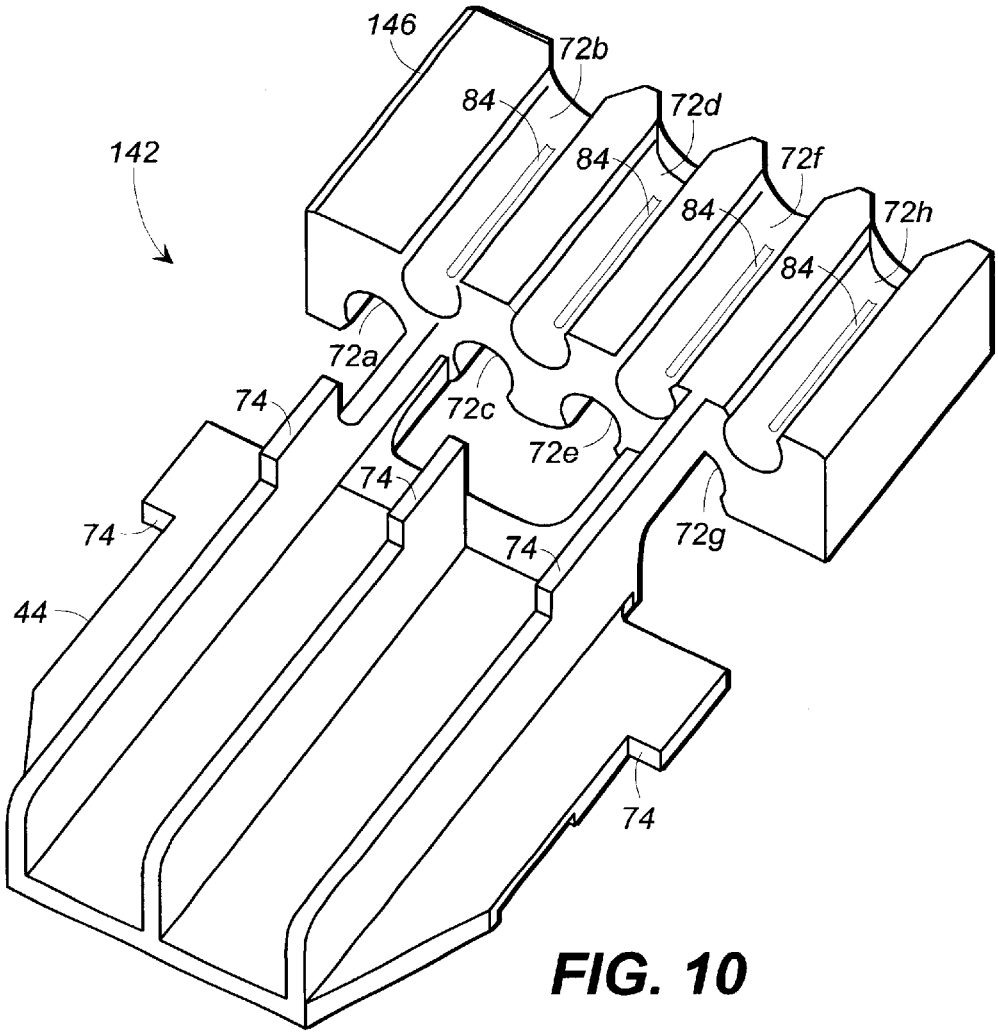
FIG. 10 is a perspective view of an alternative design for the mandrel in which crosstalk is minimized in the communication plug.
Figure 11:
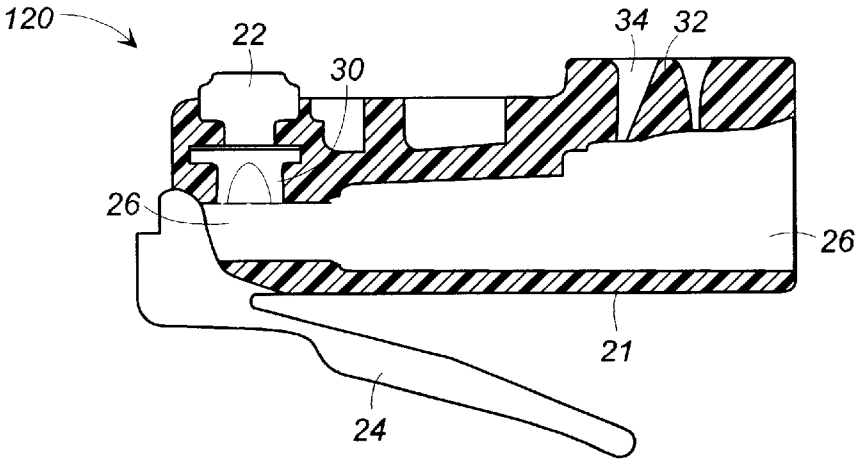
FIG. 11 is a cross sectional view of a modified communication plug for using the mandrel of FIG. 10.

To accommodate a low crosstalk plug design, an alternative embodiment for the mandrel is shown in FIG. 10 as mandrel 142. Mandrel 142 incorporates the same body 44 that was used in mandrel 42, but includes an extended conductor distribution end 146. Extended conductor distribution end 146 replaces the function of alignment region 28 in communication plug 20 (see FIG. 1). As shown in FIG. 11, chamber 26 of plug 120 extends under terminals 22 into the space formerly occupied by alignment region 28. Extended conductor distribution end 146 is received into chamber 26 and is positioned under terminals 22. For the wires in slots 72*b*, 72*d*, 72*f* and 72*h*, extended conductor distribution end 146 includes slots 84 that provide a passage way for dual prongs 30 of contacts 22 to reach the wires contained therein. Terminals 22 are crimped onto the wires held in extended conductor distribution end 146 to form the electrical connections.

Figure 13:
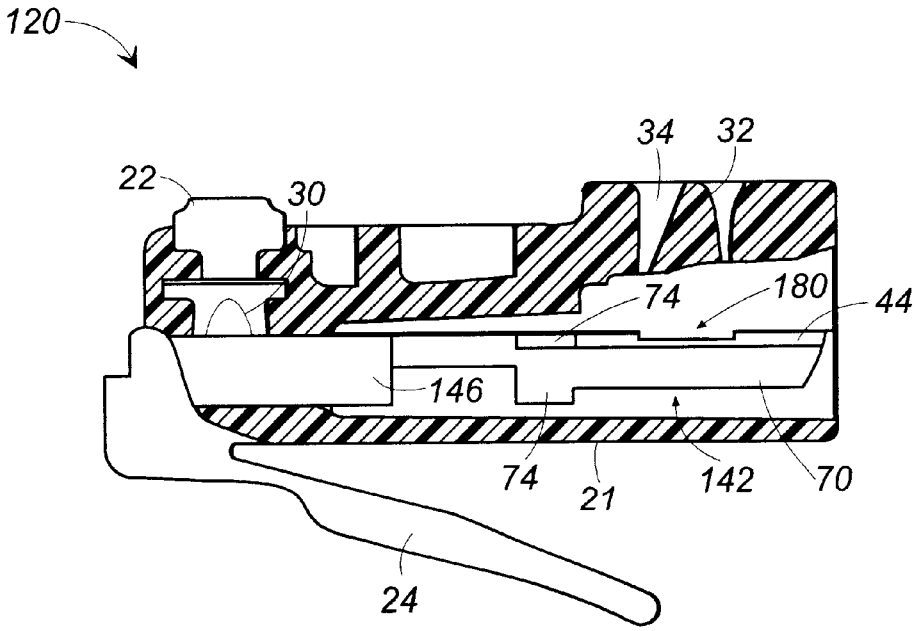
FIG. 13 is a cross sectional view of the communication plug of FIG. 11, shown with a conductor carrier disposed therein.
Figure 15:
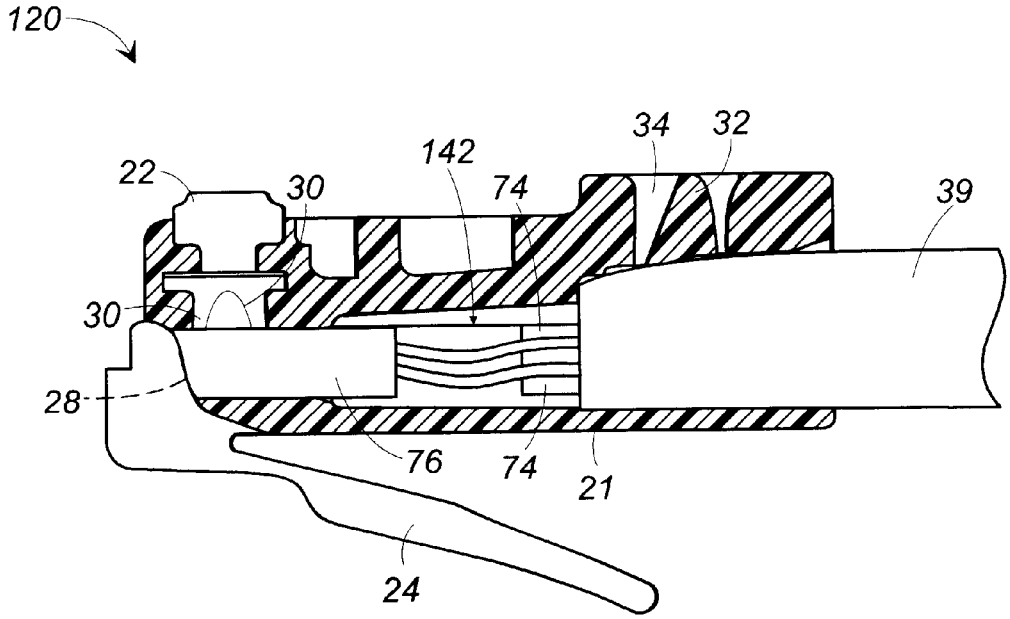
FIG. 15 is a cross-sectional view of the communication plug and conductor carrier of FIG. 13, shown with a cable inserted therein such that the conductor carrier is inserted between the cable sheath and twisted wire pairs.

Mandrel 142 allows the twist in the individual wire pairs to be maintained up until the wires are routed to their respective slots in extended conductor distribution end 146. Accordingly, crosstalk between the wire pairs is kept to a minimum because the length in which the wire pairs are untwisted and running parallel to one another is kept at a minimum. FIG. 13 shows the conductor carrier or mandrel 142 disposed in the communication plug 20. FIG. 15 shows a communication cable inserted in the communication plug 120 such that the conductor carrier 142 is disposed between the cable sheath 39 and the wire pairs.

In addition to minimizing crosstalk, Mandrel 142 substantially reduces assembly time over prior art communication plug designs. Once a portion of sheath 39 is removed from the end of the cable, an assembly person can insert mandrel 142 underneath cable sheath 39, untwist each wire pair and snap the individual wires into their respective slots 72 outside of communication plug 120. At this point, completion of the plug assembly is simple as the wires are trimmed and mandrel 142 is inserted into chamber 26 until extended distribution end 146 reaches terminals 22 at the nose of the plug. In this position, terminals 22 are crimped onto the wires and anchor bar 32 (see FIG. 4) is locked into its operative position to secure the cable in place.

The principles of the invention have been illustrated herein as they are applied to a communications plug or connector. From the foregoing, it can readily be seen that the unique plug can be configured to optimize crosstalk generated therein through precise milling of an inexpensive sled component in conjunction with a mandrel for routing the individual wires to their proper locations. Alternatively, if crosstalk minimization is desired, a uniquely designed mandrel can be used that allows the twist in the individual wire pairs to be moved as close as possible to the electrical contacts. Moreover, the crosstalk minimization mandrel minimizes assembly time by allowing all wire manipulation to be done external to the plug housing.

Furthermore, the carrier or mandrel disclosed herein can be applied as a cable termination for any jacketed cable. The mandrel is inserted under the cable jacket and receives the conductors in channels formed therein to organize the positioning and routing of the conductors as they exit the end of the cable jacket. Advantageously, the mandrel maintains this organization while an anchor bar or similar strain relief mechanism is tightened over the jacket, mandrel and conductors. In addition, the mandrel can extend beyond the end of the jacket to provide alignment and/or rearrangement of conductor positions up to a termination device such as a plug carrying terminal contacts.

In concluding the detailed description, it should be noted that it will be obvious to those skilled in the art that many variations and modifications may be made to the preferred embodiment without substantially departing from the principles of the present invention. All such variations and modifications are intended to be included herein within the scope of the present invention, as set forth in the following claims.

We claim:

1. A communication plug for terminating a cable of generally circular cross-section having an outer jacket and a plurality of conductors configured as twisted pairs held therein, said plug comprising:

a conductor carrier having a substantially planar body including a top surface and a bottom surface extending outwardly from said substantially planar body and a distribution portion having a top surface and a bottom surface, said distribution portion extending forwardly from said substantially planar body, said substantially planar body being adapted to be inserted within the cable so as to fit between the twisted pairs and the cable outer jacket, said substantially planar body comprising a plurality of dividing walls extending upwardly therefrom and together with said substantially planar body forming a plurality of open, longitudinally extending channels which extend substantially along the length of said substantially planar body, wherein each of said channels are configured to confine one of the twisted pairs between the outer jacket, said substantially planar body, and at least one of said dividing walls, said distribution portion having a plurality of slots formed in said top and bottom surfaces of said distribution portion, wherein said slots each are configured to orient a single conductor of the twisted pairs of the cable in a predetermined pattern.

2. The plug of claim 1, wherein said substantially planar body and said distribution portion are longitudinally spaced from each other.

3. The plug of claim 1, wherein said slots formed in said distribution portion are open such that twisted pairs can be laid into said slots from a lateral direction.

4. The plug of claim 3, wherein said slots formed in said distribution portion are substantially arcuate in shape.

5. The plug of claim 1, wherein said dividing walls include a plurality of stops that extend therefrom, said stops being adapted to abut the edge of the cable outer jacket when said conductor carrier is inserted within the cable.

6. The plug of claim 5, wherein said substantially planar body further includes at least one stop that is adapted to abut the edge of the cable outer jacket when said conductor carrier is inserted within the cable.

7. The plug of claim 1, further comprising an outer housing having an open end, a closed end, an upper wall, a lower wall, and first and second side walls forming a chamber therein, said chamber being open at said open end and closed at said closed end, said conductor carrier being at least partially disposed in said chamber.

8. The plug of claim 7, further comprising a sled that includes a plurality of channels that are configured so as to align with the slots formed in said distribution portion of said conductor carrier, said sled disposed within said outer housing chamber adjacent said substantially planar body.

9. The plug of claim 8, wherein at least one of said channels of said sled is formed as an aperture and at least one of said channel of said sled is formed as an open slot.

10. The plug of claim 1, wherein said upper wall of said housing has an anchor bar and wherein bottom surface of said substantially planar body includes a depression, said anchor bar being configured to extend into said chamber to secure the cable within said chamber, said depression being oriented adjacent said anchor bar such that extension of said anchor bar into said chamber urges a portion of the jacket of the cable to engage said depression.

11. The plug of claim 10, wherein said depression extends transversely across said bottom surface of said substantially planar body.

12. A communication medium, comprising:

a communication cable which is generally circular in cross-section, said communication cable having an outer jacket and a plurality of conductors configured as twisted pairs held therein; and a communication plug connected to an end of said communication cable, said plug comprising a conductor carrier having a substantially planar body and a distribution portion, said substantially planar body having a top surface and a bottom surface, said distribution portion extending forwardly and substantially orthogonally from said substantially planar body, said substantially planar body of said communication plug being inserted within the cable so as to fit between the twisted pairs and the cable outer jacket, said substantially planar body comprising a plurality of dividing walls extending upwardly therefrom and together with said substantially planar body forming a plurality of open, longitudinally extending channels which extend substantially along the length of said substantially planar body, wherein each of said channels are configured to confine one of the twisted pairs between the outer jacket, said substantially planar body, and at least one of said dividing walls, said distribution portion having a plurality of slots formed in said top and bottom surfaces of said distribution portion, wherein said slots each are configured to orient a single conductor of the twisted pairs of the cable in a predetermined pattern.

13. The communication medium of claim 12, wherein said substantially planar body and said distribution portion are longitudinally spaced from each other.

14. The communication medium of claim 12, wherein said slots formed in said distribution portion are open such that twisted pairs can be laid into said slots from a lateral direction.

15. The communication medium of claim 12, wherein said slots formed in said distribution portion are substantially arcuate in shape.

16. The communication medium of claim 12, wherein said dividing walls include a plurality of stops that extend therefrom, said stops abutting the edge of the cable outer jacket.

17. The communication medium of claim 16, wherein said substantially planar body further includes at least one stop that abuts the edge of the cable outer jacket.

18. The communication medium of claim 12, further comprising an outer housing having an open end, a closed end, an upper wall, a lower wall, and first and second side walls forming a chamber therein, said chamber being open at said open end and closed at said closed end, said conductor carrier being at least partially disposed in said chamber.

19. The communication medium of claim 18, further comprising a sled that includes a plurality of channels that are configured so as to align with the slots formed in said distribution portion of said conductor carrier, said sled disposed within said outer housing chamber adjacent said substantially planar body.

20. The communication medium of claim 19, wherein at least one of said channels of said sled is formed as an aperture and at least one of said channel of said sled is formed as an open slot.

21. The communication medium of claim 12, wherein said upper wall of said housing has an anchor bar and wherein bottom surface of said substantially planar body includes a depression, said anchor bar being configured to extend into said chamber to secure the cable within said chamber, said depression being oriented adjacent said anchor bar such that extension of said anchor bar into said chamber urges a portion of the jacket of the cable to engage said depression.

22. The communication medium of claim 21, wherein said depression extends transversely across said bottom surface of said substantially planar body.

* * * * *